US006665407B1

(12) United States Patent
Dicker et al.

(10) Patent No.: US 6,665,407 B1
(45) Date of Patent: Dec. 16, 2003

(54) THREE CHANNEL PANNING SYSTEM

(75) Inventors: Sam Dicker, Santa Cruz, CA (US); Jean-Marc Jot, Aptos, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/407,686

(22) Filed: Sep. 28, 1999

Related U.S. Application Data

(60) Provisional application No. 60/102,192, filed on Sep. 28, 1998.

(51) Int. Cl.[7] ..... H04R 5/00
(52) U.S. Cl. ..... 381/23; 381/19
(58) Field of Search ..... 381/17, 18, 19, 381/20, 22, 23

(56) References Cited

U.S. PATENT DOCUMENTS 4,081,606 A * 3/1978 Gerzon ..... 381/19
4,392,019 A * 7/1983 Halliday ..... 381/19
5,671,287 A * 9/1997 Gerzon ..... 381/1

* cited by examiner

*Primary Examiner*—Forester W. Isen
*Assistant Examiner*—Brian T. Pendleton
(74) *Attorney, Agent, or Firm*—Blakely, Sokoloff, Taylor & Zafman LLP

(57) ABSTRACT

A technique for panning over four speakers utilizes an internal three-channel representation (Left, Right, W) where all channel weights are positive. The three channels are combined by a decoder to drive pairs of front and back speakers.

11 Claims, 3 Drawing Sheets

THREE CHANNEL PANNING SYSTEM

CROSS-REFERENCES TO RELATED APPLICATIONS

This application claims priority from provisional application Serial No. 60/102,192, filed Sep. 28, 1998, entitled "Three Channel Panning System," the disclosure of which is incorporated herein by reference.

BACKGROUND OF THE INVENTION

This invention relates to signal processing. Specifically, the present invention relates to encoding and decoding audio signals for driving multiple speakers.

Many systems have been developed to reproduce three-dimensional sound effects using multiple loudspeakers. One of the most sophisticated systems is the Ambisonic method of recording information about a sound field for reproduction over some form of loudspeaker array so as to produce the impression of hearing a true three-dimensional sound image.

The Ambisonic system encodes a three-dimensional soundfield in a B-format which is defined as follows:

X=cos(Az) (front-back velocity signal)

Y=sin(Az) (left-right velocity signal)

W=0.707 (pressure signal)

where the vertical dimension has been ignored and Az is the azimuth (horizontal panning angle) of the sound source.

Note that the Y component can be positive or negative which requires a signal processing unit which can generate negative values. However, some systems are capable of generating only positive loudspeaker weights and are unable to implement B format encoding.

SUMMARY OF THE INVENTION

According to one aspect of the present invention, a method and system for panning sounds over four speakers employs a three-channel representation of the same. With the present invention, panning sounds over four speakers (denoted L,R,SL,SR) may be achieved while employing a three-channel representation of channels (L,R,W). However, (L,R,W) is more convenient than (W,X,Y) because it already contains the signals for the two front speakers.

When the three-channels are converted to four speaker feeds, it is ensured that positive loudspeaker weights are produced instead of out of phase feeds in the loudspeakers opposite the direction from where the sound is panned, as is done using the Ambisonic prior art technique.

According to another aspect of the invention, this is achieved by using a sine-cosine panning technique to pan over a pair of left and right channels, while including the unprocessed input signal (W) in this three-channel form at. A subsequent operation then allows deriving the two rear channel signals for reproduction over four speakers. In this fashion, the three-channel format (L,R,W) could be decoded over any horizontal multi-channel loudspeaker setup.

According to one aspect of the invention, panning over four loudspeakers is implemented utilizing an internal representation having three channels.

According to another aspect of the invention, a signal including an audio portion and angular information is encoded in Left, Right, and W channels where all channel weights have positive values.

According to another aspect of the invention, sine/cosine panning, using the raised cosine function, is utilized to calculate Left and Right speaker weights and the W channel is equal to the input audio signal.

According to another aspect of the invention, the Left and Right channels are used directly to drive front loudspeakers while the other loudspeakers are driven by combinations of the Left, Right, and W channel.

The use of only positive weights in the three-channel format is convenient for hardware designers because it is easier to design hardware to implement positive weights. Also, subsequent to decoding, the positive weights allow the panning of signals from front left to right (or vice versa) with no signals sent to the rear speakers, which results in more realistic effects.

Other features and advantages of the invention will be apparent in view of the following detailed description and appended drawings.

BRIEF DESCRIPTION OF THE DRAWINGS

FIGS. 4A–4C are graphs depicting channel weight signals calculated in herical coordinates;

DESCRIPTION OF THE SPECIFIC EMBODIMENTS

Figure 1:
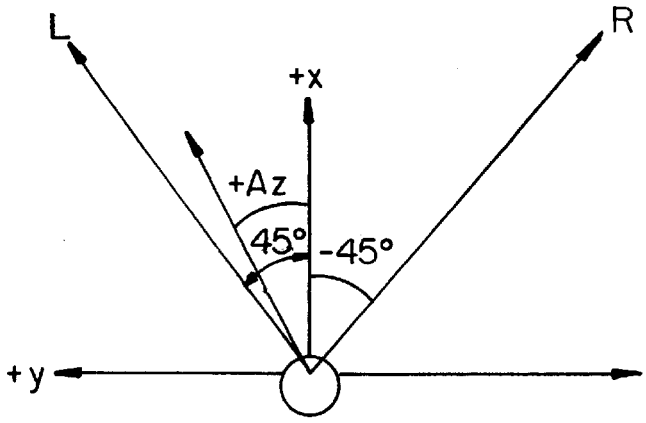
FIG. 1 is a schematic diagram of the coordinate system utilized to calculate speaker weights for the left and right channels.

The preferred embodiment of the technique for encoding an audio signal into the Left, Right, W (L,R,W) format will now be described with reference to FIG. 1.

Notations:

P=input signal.

Az=azimuth (horizontal panning angle) measured in degrees anti-clockwise in view from top, with 0 degrees in front where this information is included for each signal. The orientation of the azimuthal angle relative to a listener and (x,y) coordinate system is depicted in FIG. 1. Note that the left and right speaker positions are defined for +45° and 45° respectively.

El=elevation (vertical panning angle) measured in degrees (from −90° to +90°), with 0° in the horizontal plane and +90° directly on top.

Encoding: 3-channel formulas producing (L,R,W) format in spherical coordinates uses the raised cosine function to produce only positive loudspeaker signals:

W=P;

$$L=P*(1+\cos(Az-45°))/2; \quad \text{(Eq. 1)}$$

$$R=P*(1+\cos(Az+45°))/2. \quad \text{(Eq. 2)}$$

Encoding: an alternative 3-channel panning formulas producing (L,R,W) signals using Cartesian coordinates:

W=P;

$$L=P*(\min\{\max[(x-y), -1], 1\}+1)/2 \quad \text{(Eq. 3)}$$

$$R=P*(\min\{\max[(x+y), -1], 1\}+1)/2 \quad \text{(Eq. 4)}$$

where the max[ ] function clamps (x−y) or (x+y) to be greater than −1 and min( ) clamps the output of max[ ] to be less than 1, and where X and Y are defined by X=cos(Az)*cos(EL) and Y=sin(Az)*cos(El) where X points towards the front and Y towards the left. In the above, the coefficients of P are the (L,R,W) weights.

Generally, the (L,R,W) panning function has to have L and R components having a magnitude between 0 and 1 which are also symmetric about 0.5. Also, in each case L and R are related by:

$$R(Az)=L(Az+90°)$$

Figure 2:
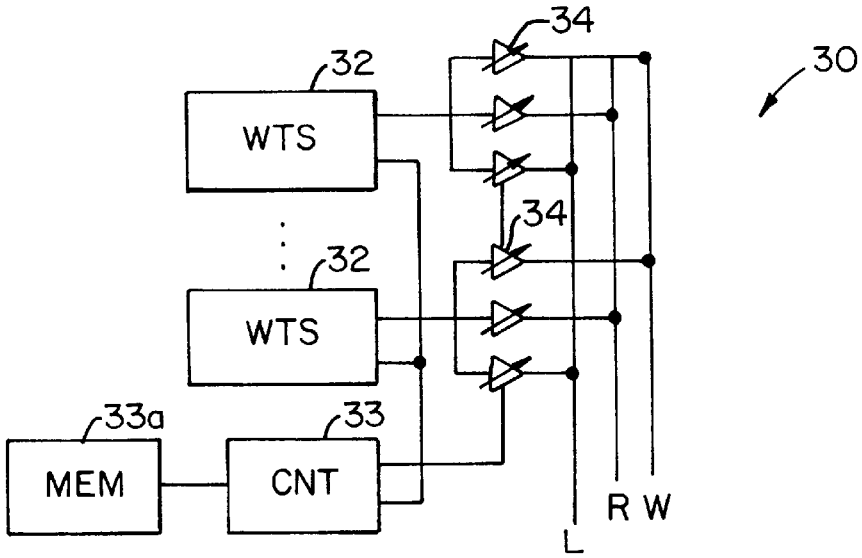
FIG. 2 is a block diagram of an encoder.

FIG. 2 is a block diagram of part of an encoder 30 for implementing horizontal encoding. As described above, each wave-table synthesizer 32 outputs a signal including an audio portion and azimuthal angle information. A controller 33, under control of program code stored in store 33*a*, calculates the L and R weights according to equations (1) and (2) based on the azimuthal information output by the wave-table synthesizers 32. The output of each wave-table synthesizer is split into three channels and the amplitude of audio signal is modified by adjustable gain amplifiers 34 under control of the controller 33 according to the above formulae to generate the L, R, and W signals. Note that all the weights applied by the amplifiers are positive.

Decoding to 4 speakers (L,R,W) to (L,R,SL,SR)

L=L;

R=R;

SL(surround left)=W−R;

SR(surround right)=W−L.

Figure 3:
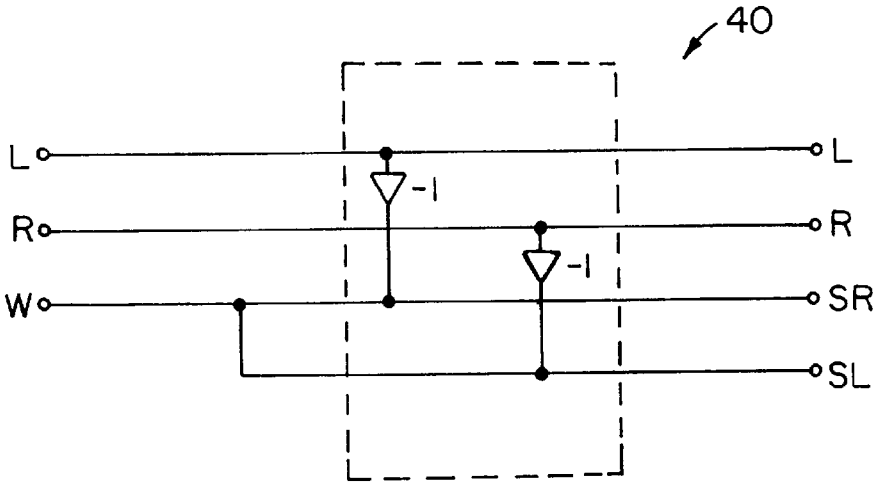
FIG. 3 is a block diagram of a decoder.

FIG. 3 is a block diagram of a system for implementing the above decoding. A decoder matrix 40 combines the (L,R,W) channels to form the (L,R,SL,SR) output signals.

Thus, as described above, in (L,R,W) encoding the L and R channels are fed directly to the front loudspeakers. In the preferred embodiment W=1 and, as described above, L and R are symmetric about 0.5, SR is the reflection of L about 0.5 and SL is the reflection of R about 0.5.

Figure 4A:
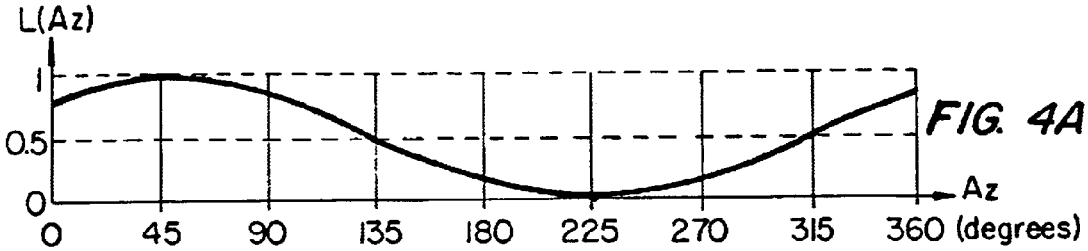
Figure 4B:
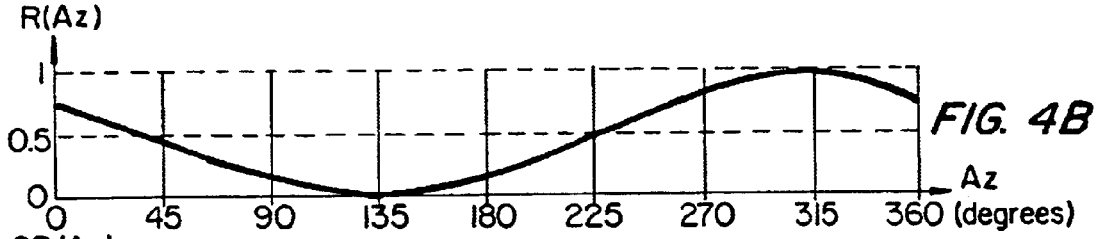

The L, R, SL, and SR signals with L and R calculated by Eqs. 1 and 2 are depicted in FIGS. 4A–4C. In this case:

$$SR(Az)=1-L(Az)=L(Az+180°);\text{ and}$$

$$SL(Az)=1-R(Az)=R(Az+180°).$$

Figure 5:
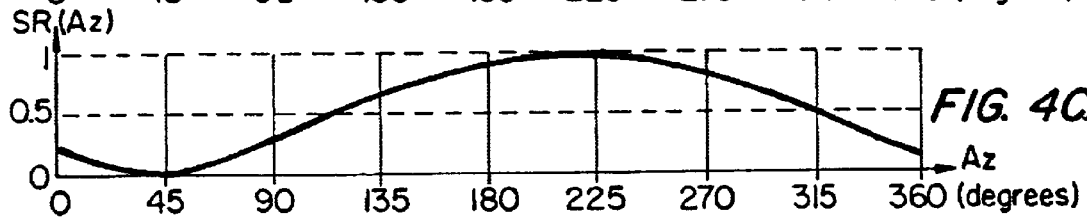
FIG. 5 is a graph depicting a channel weight signal calculated in Cartesian coordinates.
Figure 5:
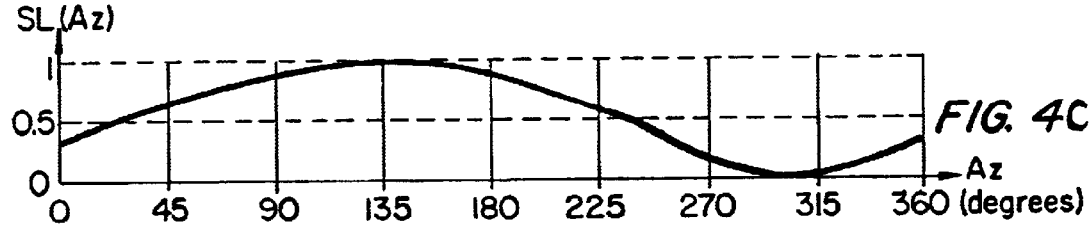
Figure 5:
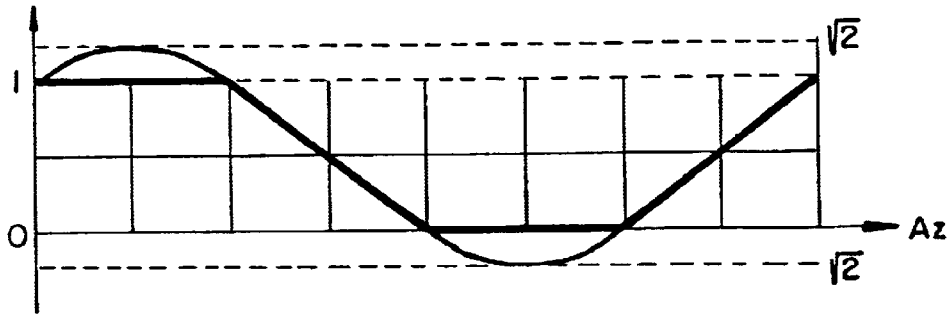

The L signal calculated by Eq. 3 is depicted in FIG. 5.

Figure 6:
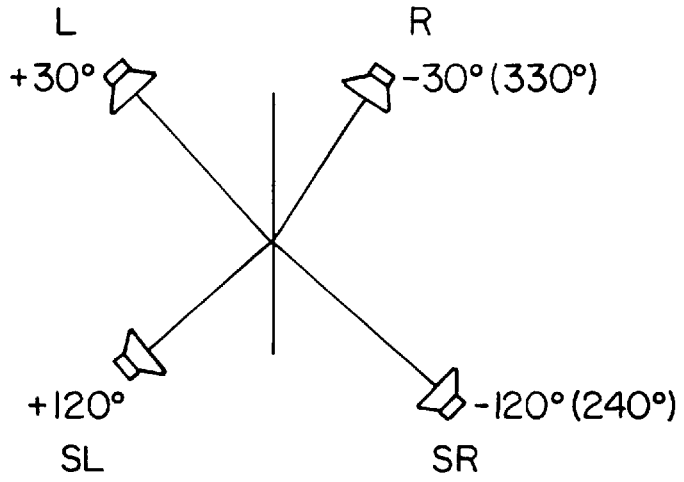
FIG. 6 is a schematic diagram of a non-square speaker configuration.
Figure 7:
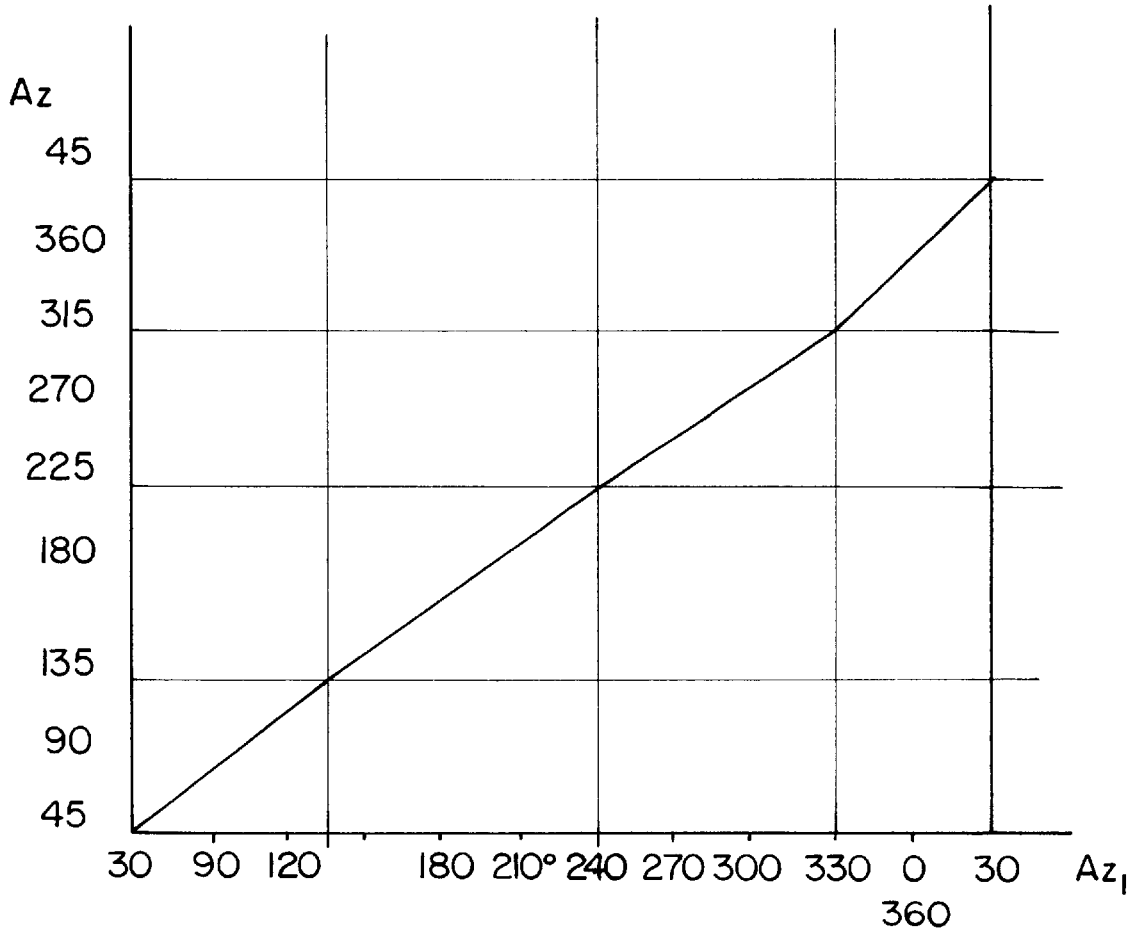
FIG. 7 is a graph of a mapping for use with the speaker configuration of FIG. 6.

The above (L,R,W) encoding scheme places the speakers in square with L and R at ±45°. However, the system can be utilized for other configurations utilizing simple linear mapping. For example, if the speakers were in a rectangle with L and R at ±30° and SL and SR at ±120° (depicted in FIG. 6) then the azimuthal angle would be designated $Az_1$. Equations (1) and (2) require mapping $Az_1$ to Az. For this case the mapping is shown in FIG. 7. Note that for the $Az_1$ to Az mapping, +30° is mapped to +45°; −30° is mapped to −45°; +120° is mapped to +135°; and +240°(−120°) is mapped to +225°(−135°). Thus, the L,R,SL, and SR signals are mapped directly to the loudspeakers at the appropriate angles. The mapping is linear between these points.

The invention has now been described with reference to the preferred embodiments. Alternatives and substitutions will now be apparent to persons of skill in the art. In particular, the (L,R,W) channels can be combined to drive more than four loudspeakers. A linear combination of L, R, and W, e.g., a*L+b*R+c*W would be used as a feed to each loudspeaker with an appropriate triplet (a,b,c) for each speaker. Further, both the encoder and decoder could be implemented digitally or in analog parts. Accordingly, it is not intended to limit the invention except as provided by the appended claims.

What is claimed is:

1. A system for directionally encoding an audio signal reproducing it over a plurality of loudspeakers comprising:

an encoder for encoding a received signal including an audio portion and an azimuthally information portion into Left, Right, and W (L,R,W) channels, with the encoder for calculating left and right channel weights having an amplitude between 0 and 1 and where, for an azimuthally angle (Az), R(Az)=L(Az+90°) and 1−L(Az)=L(Az+180°); and a decoder for receiving said L and R channels and the W channel equal to the audio portion of the signal, with the decoder for providing said Left channel, said Right channel, wherein the decoder provides a Surround Left channel equal to the difference of the W and Right channels and wherein the decoder provides a Right surround channel equal to the difference of the W and Left channels.

2. The system of claim 1 with said encoder further comprising:

an (L,R,W) bus having L, R, and W conductors;

L, R, and W weighting amplifiers coupled, respectively, to said L, R, and W lines of said (L,R,W) bus, with said weighting amplifiers for amplifying said audio portion according to said left and right channel weights.

3. The system of claim 1 with the encoder further comprising:

a processor for calculating said left and right channel weights according to L(Az)=(1+cos(Az−45°))/2 and R(Az)=(1+cos(Az+45°))/2, where L is the left channel weight, R is the right channel weight, and Az is an azimuth (horizontal panning angle) measured in degrees anti-clockwise in view from top, with 0 degrees in front.

4. The system of claim 1 with said encoder further comprising:

a processor for calculating the left and right channel weights according to L(x,y)=(0.5*min{max[(x−y), −1], 1}+½) and R(x,y)=(0.5*min{max[(x+y), −1], 1}+½) where L is the left channel weight, R is the right channel weight, and Az is an azimuth (horizontal panning angle) measured in degrees anti-clockwise in view from top, with 0 degrees in front and where the max[ ] function clamps (x−y) or (x+y) to be greater than −1 and min( ) clamps the output of max[ ] to be less than 1, and where x is proportional to cos(Az) and y is proportional to sin(Az) and where x points towards the front and y towards the left.

5. A method of generating a plurality of loudspeaker weights based on a received signal including an audio portion and an angular information portion, said method comprising the steps of:

calculating Left and Right channel weight values using a sine/cosine panning technique based on the raised cosine function to avoid negative weights;

modifying the amplitude of the audio portion according to the calculated channel weight values to generate the Left and Right channels;

subtracting the Right channel from the audio portion to generate a Surround Left channel; and subtracting the Left channel from the audio portion to generate a Surround Right channel.

6. The method of claim 5 where said step of calculating comprises the step of:

calculating said left and right channel weights according to L(Az)=(1+cos(Az−45°))/2 and R(Az)=(1+cos(Az+

45°))/2, where L is the left channel weight, R is the right channel weight, and Az is an azimuth (horizontal panning angle) measured in degrees anti-clockwise in view from top, with 0 degrees in front.

7. The method of claim 5 where said step of calculating comprises the step of:

calculating the left and right channel weights according to $L(x,y)=(0.5*\min\{\max[(x-y), -1], 1\}+½)$ and $R(x,y)=(0.5*\min\{\max[(x+y), -1], 1\}+½)$ where L is the left channel weight, R is the right channel weight, P is the amplitude of the audio portion, and Az is an azimuth (horizontal panning angle) measured in degrees anti-clockwise in view from top, with 0 degrees in front and where the max[ ] function clamps (x−y) or (x+y) to be greater than −1 and min( ) clamps the output of max[ ] to be less than 1, and where x is proportional to cos(Az) and y is proportional to sin(Az) and where x points towards the front and y towards the left.

8. A computer program product comprising:

a computer readable storage structure embodying computer readable code therein, with said computer readable code for controlling a data processing unit to generate loudspeaker channels and with said computer readable code comprising:

computer readable program code for calculating Left and Right channel weight values using a sine/cosine panning technique based on the raised cosine function to avoid negative weights;

computer readable program code for modifying the amplitude of the audio portion according to the calculated channel weight values to generate the Left and Right channels;

computer readable program code for subtracting the Right channel from the audio portion to generate a Surround Left channel; and computer readable program code for subtracting the Left channel from the audio portion to generate a Surround Right channel.

9. The audio system of claim 1 wherein the Left channel and the Right channel drive front loudspeakers.

10. The audio system of claim 9 wherein combinations of the Left and right Channel drive rear loudspeakers.

11. The audio system of claim 10 wherein the positive channels weights allow panning of signals to the front speakers with no signal in the rear speakers.

* * * * *